US005735093A

United States Patent [19]

Grutsch

[11] Patent Number: 5,735,093

[45] Date of Patent: Apr. 7, 1998

[54] CONCRETE FORMWORK WITH BACKING PLATES

[76] Inventor: George A. Grutsch, 6455 Meadowood La., Missoula, Mont. 59803

[21] Appl. No.: 705,500

[22] Filed: Aug. 29, 1996

Related U.S. Application Data

[60] Provisional application Nos. 60/003,242, Sep. 5, 1995, and 60/011,540, Feb. 13, 1996.

[51] Int. Cl.[6] ..... E04B 2/40; E04B 1/38

[52] U.S. Cl. ..... 52/309.11; 52/309.12; 52/426; 52/565; 52/562; 52/742.14; 52/745.2; 52/747.1

[58] Field of Search ..... 52/309.12, 309.11, 52/309.7, 309.2, 699–701, 562, 564, 565, 424–426, 591.4, 742.14, 745.2, 747.1

[56] References Cited

U.S. PATENT DOCUMENTS 3,772,842 11/1973 Barbera .
4,516,372 5/1985 Grutsch .
4,879,855 11/1989 Berrenberg .

FOREIGN PATENT DOCUMENTS 2111730 12/1972 Germany .
2255810 5/1974 Germany .

OTHER PUBLICATIONS

Advertising materials for Diamond Snap–Form, undated, 55 pages.

Advertising materials for ConForm, undated, 4 pages.

Assembly Instructions, Lite–Form T–Intersection Using T–Tie, date 1994, 1 page.

Advertising material for Reddi–Form, undated, 4 pages.

*Primary Examiner*—Robert Canfield
*Attorney, Agent, or Firm*—William D. Hall

[57] ABSTRACT

Foam forms for use in making a concrete wall are disclosed together with a method of making the forms. The forms are stackable to form a cavity that receives the concrete. Each form has two identical panels. The panels are molded separately by first placing a structure, consisting of backing plates that will be along one side of the mold, connecting members that will be along the opposite side of the mold and an apparatus that connects the backing plates to the connecting members, in the mold. The mold is then filled with foam which cures and produces a panel with the backing plates, connecting members and apparatus molded into the panel. The molded panels are then shipped to the job site where the forms are assembled. Each form is assembled as follows: The connecting members on one panel are interconnected, by tieing means, to the connecting members on a second panel to provide a form.

18 Claims, 7 Drawing Sheets

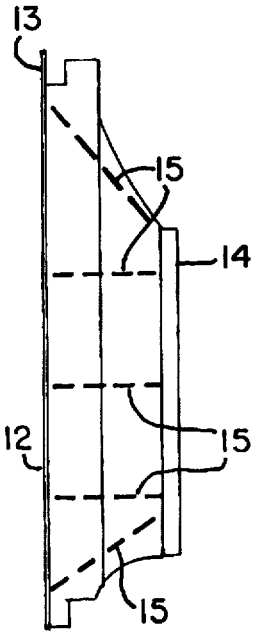
FIG. 3
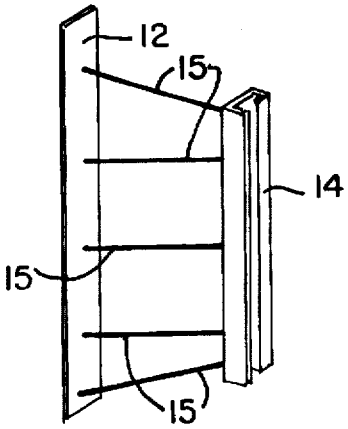
FIG. 4
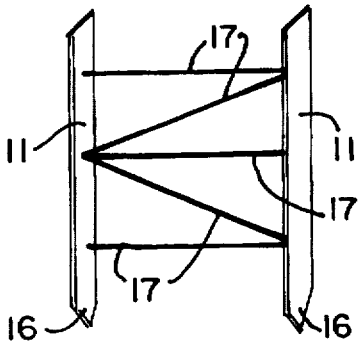
FIG. 5
FIG. 6
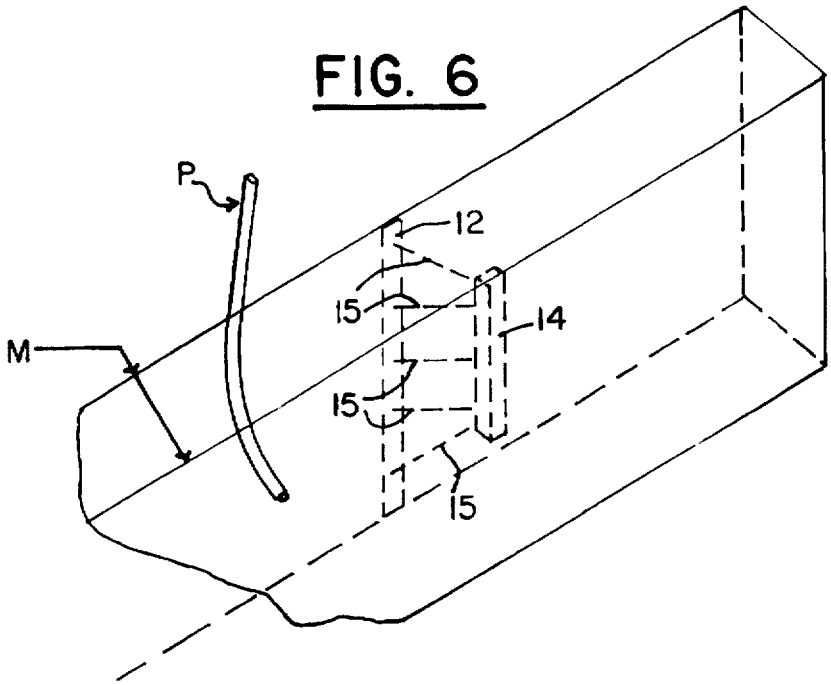

FIG. 7
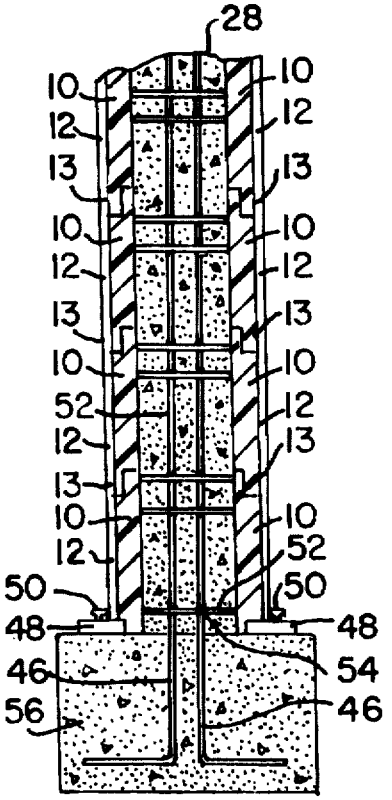
FIG. 9
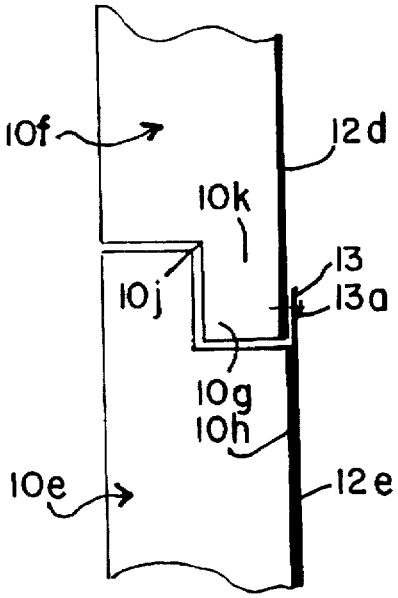
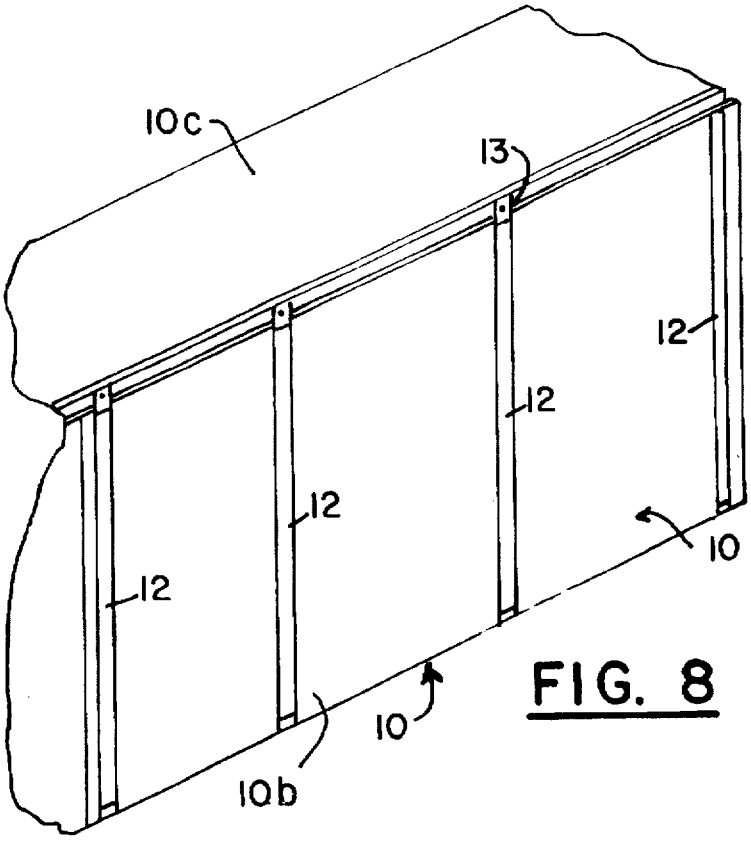
FIG. 8

FIG. 10
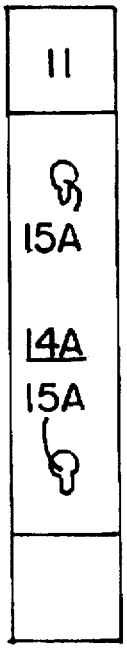
FIG. 11
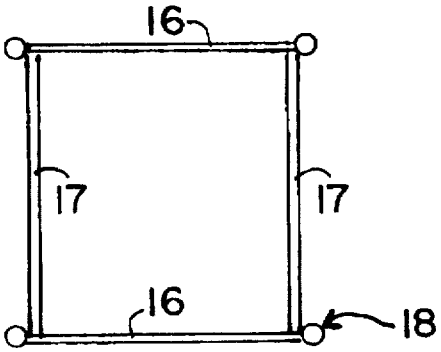
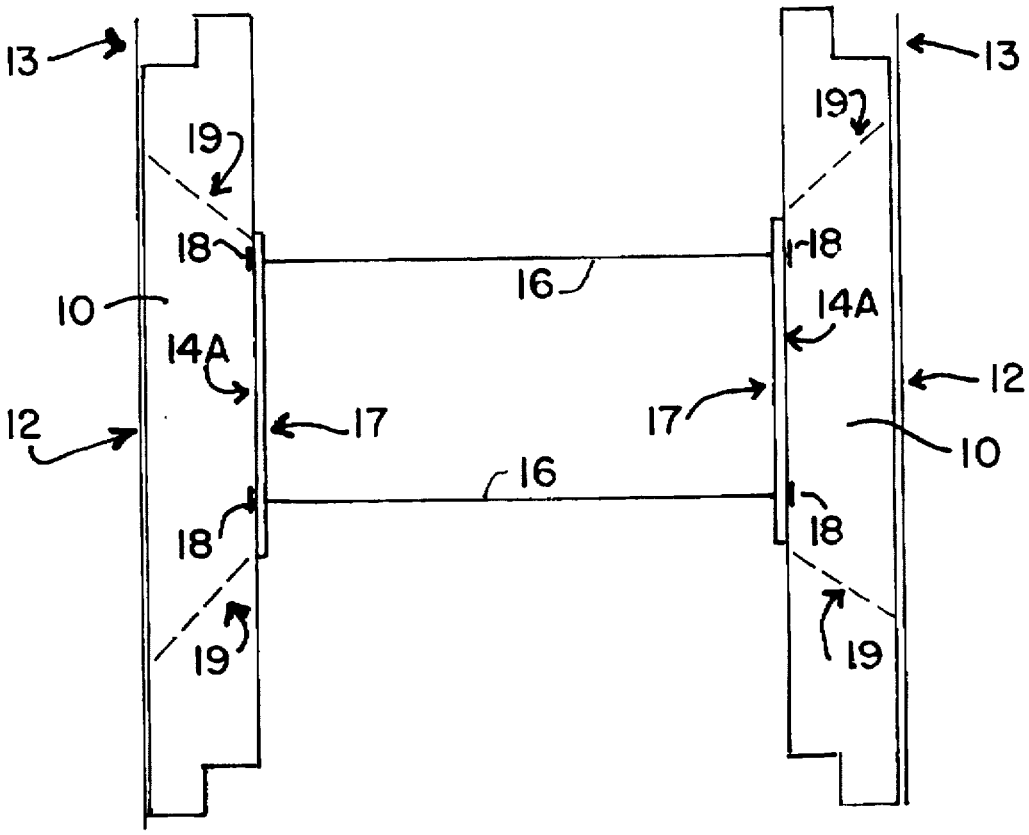
FIG. 12

CONCRETE FORMWORK WITH BACKING PLATES

This application is a continuation of my prior copending provisional applications Ser. No. 60/003,242, filed Sep. 5, 1995 and Ser. No. 60/011,540, filed Feb. 13, 1996.

This invention relates to forms into which concrete is poured in order to erect a concrete wall, and to walls made with the new forms.

BACKGROUND OF THE INVENTION

Generally, forms for building walls have been made of wood or steel but there has been a growing trend to make such forms of a low density foam. There are a number of these low density foam forms in the prior art and on the market. The most widely used type of these forms comprises a pair of parallel vertical foam panels spaced apart by the thickness of the wall. The forms are held in place by plastic or metal support members that extend completely through both of the parallel panels. The panels are protected against outward forces, exerted by the fluid concrete, by backing plates that are adjacent to the exterior walls of the panels and are mechanically interconnected by the tieing means. Examples of such constructions include my U.S. Pat. No. 4,516,372 dated May 14, 1985, and U.S. Pat. No. 4,879,855 to John L. Berrenburg dated Nov. 14, 1989.

One problem with most of the low density forms now on the market is that they are made in a factory some distance from the locations of dealers and builders. Since the more common types of the low density forms on the market have the panels thoroughly braced by rigid tieing means, the dealers and builders must stock a different set of the forms for each width of wall that may be built. Further, when these forms are shipped they take up much space because there is much empty space between the panels. There are foam blocks on the market that avoid the above problems but they are inherently weak since there is nothing embedded in the form and any backing for the forms is minimal.

It is an object of the present invention to overcome all of the problems associated with the above-mentioned low density foam forms.

SUMMARY OF THE INVENTION

My invention has foam panels of about the same size, shape and material as the foam forms referred to above; that is each panel is about four feet long, 1.5 feet high and two inches thick. Each of my panels has an internal structure embedded in the panel, which in combination with backing plates preserves the panel against distortion during the pouring of the fluid concrete. My panels, however, are not interconnected at the factory. The lack of a factory connection permits the panels to be shipped stacked one upon the next without any intervening spaces between panels.

When the panels arrive at the construction site, pairs of panels are joined with the tie member of a length equal to the desired width of the concrete wall. Hence, the panels can be joined by tieing members, by the dealer or builder, avoiding the necessity of stocking a different set of panels for each wall thickness.

The particular form of the tieing means between panels and of the connection of the tieing means to the structural elements in the panels is also part of my invention.

Another feature of this invention is that the backing plates on one form may overlap a small portion of an adjacent form.

BRIEF DESCRIPTION OF THE DRAWINGS

FIG. 3 is a cross section of one of the panels of the invention.

FIG. 4 is an isometric view of a strong structure that is partially embedded in the foam forms of the invention.

FIG. 5 is a tieing means that ties two panels together.

FIG. 6 is a schematic drawing of the mold, the structure that goes in the mold and the pipe for feeding the plastic into the mold.

FIG. 7 is a concrete wall constructed with the formwork of this invention.

FIG. 8 is a partial isometric view of the preferred form of panel, and backing plates, showing in particular the outer surface.

FIG. 9 shows two panels one stacked on the other.

FIG. 10 is a front view of a connecting means.

FIG. 11 is a front view of the tieing means that cooperates with the two strong structures in the two panels to hold them together.

FIG. 12 is a cross-sectional view through the assembled panels showing in particular the two strong structures tied together with the tieing means.

DETAILED DESCRIPTION

Hereinafter, whenever I refer to foam forms, I will be referring to low density foam materials such as polyurethane may be used, having a density below 4.5 pounds per cubic foot (4.5 p/cf) and preferably has a density in the range of 1.5 to 3 P/CF. Further details of a suitable foam are set forth in column 6 of my patent U.S. Pat. No. 4,516,372. Other low density materials such as polystyrene, may be used. The low density materials will remain a part of the concrete wall and act as an insulator for the wall. If the wall is an outside wall of a building the insulation will reduce heating and cooling costs, as well as reduce sound transmission.

Figure 1:
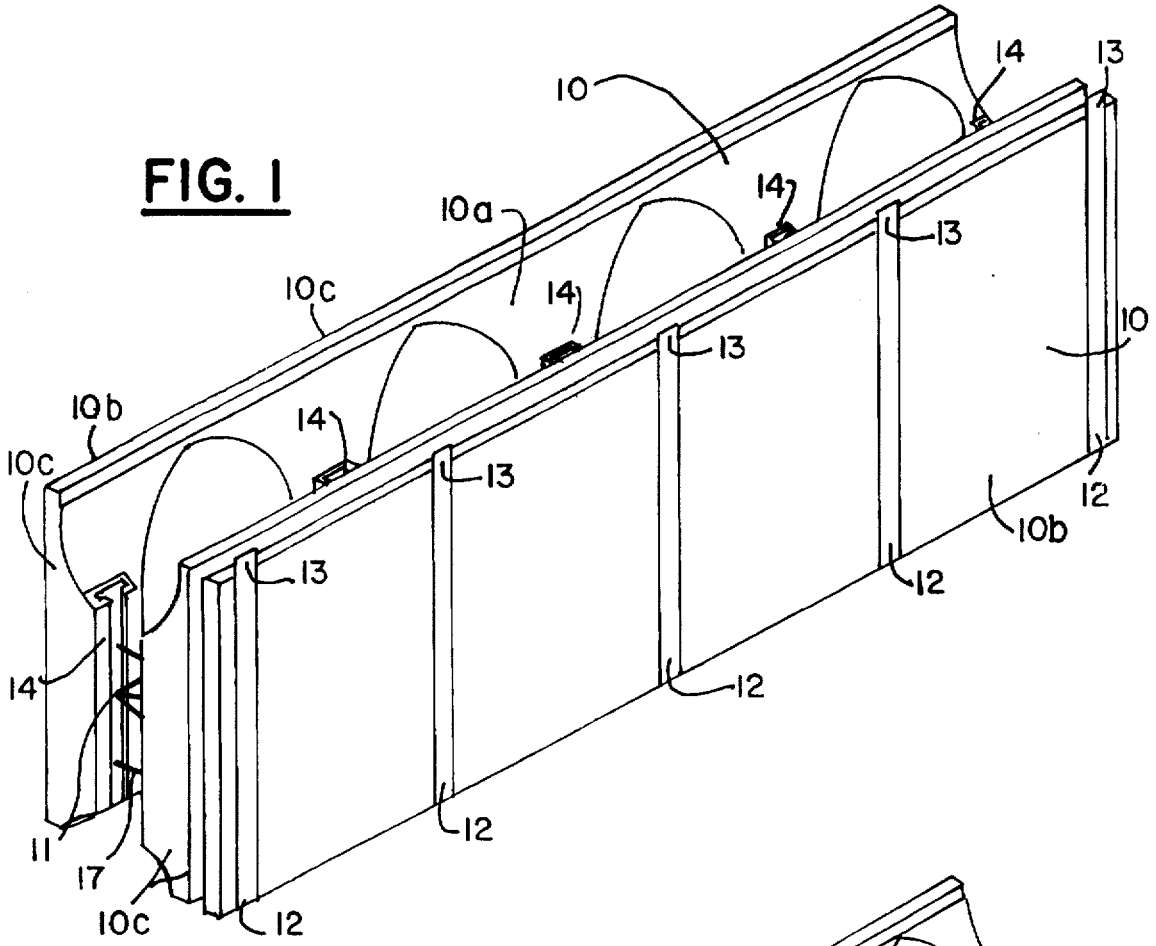
FIG. 1 is an isometric view of one form of the invention.
Figure 2:
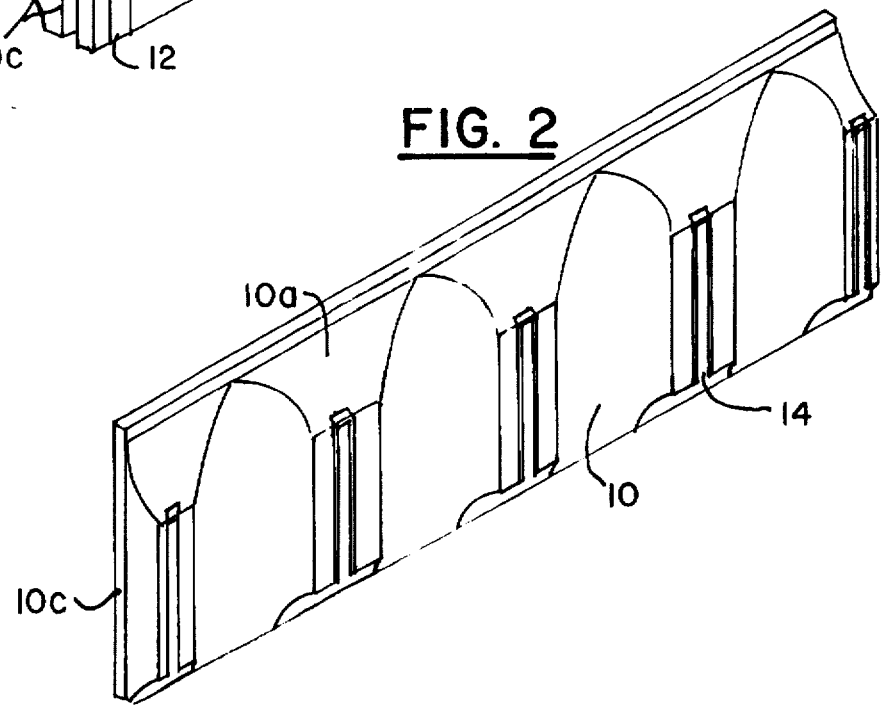
FIG. 2 is an isometric view of an inside face of a panel which is part of the invention.

FIG. 1 shows one form of the invention. There are two low density foam panels 10 which were separate from each other during manufacture at the factory and shipping to the dealer or builder. These two panels 10 have inner faces 10*a* that include sockets 14 as shown in FIG. 2. Each panel has at least one and preferably several strong structures (FIGS. 3 and 4) which comprise a backing plate 12, a socket 14 and strong connecting members 15 that connect the socket to the backing plate. The two sockets 14 on the two panels 10, respectively are interconnected by the inside tie shown in FIG. 5. The inside tie has two strips 11 which are pointed at their lower ends 16, and which are also connected to each other by internal strong members 17. Two or more of the ties of FIG. 5 may be connected by a member 18 so that they can be installed as a unit.

The apparatus shown in FIGS. 4 and 5 is quite strong as compared to the strength of the low density foam panels.

The low density foam forms 10, in the absence of the strong structures of FIGS. 4 and 5 would be destroyed or at least distorted, when used to build a concrete wall. Great force on the panels 10 occurs when the panels are stacked and fluid concrete is poured into the space between the panels 10. The strong structures of FIGS. 4 and 5 are used to not only space the panels apart by a distance equal to the thickness of the concrete wall but to also provide strength to the panels 10. This permits pairs of panels to be installed as a unit and also prevents lateral movement of the panels.

As shown in FIGS. 1 and 2 there are five strong structures . (FIGS. 3 and 4) in each panel 10. Hence there are five tieing member (FIG. 5) for each pair of panels. Each of the five strong structures of FIG. 4 that are in each panel 10, have a backing plate 12, a socket 14 and members 17. The strong structures of FIGS. 3 to 5 perform at least two major functions. First, they strengthen the panels in two ways. The first of these ways is that since the structural elements 15 were molded into the panels and the backing plates 12 and the sockets 14 abut the surfaces of the panels 10, the panels 10 are strengthened. The backing plates act as bearing plates, distributing the stresses over a greater area of the foam panel. Secondly, the backing plates 12 may support wall coverings of all types. If the wall is an outside wall of a building, the exterior face **10*b* of the panel 10, that is on the outside of the building, may support siding or any other outside wall covering. Inside the building, the outer face 10*b* of the panel 10** may support dry wall, sheetrock, etc.

The prior art teaches backing plates on (or in indents in the foam panel) foam panels, but my backing plates 12 are an improvement since they have a portions 13 which actually overlap the joints between the panels 10 of first pair of panels and a second pair of panels that are above the first pair. Moreover, my backing plates also act as bearing plates. Moreover, the portions of my backing plates that overlap can be fastened together. That is, the backing plate portion 13 can be fastened by a screw **13*a* to backing plate 12*d* (see FIG. 9**).

The foam panels 10, with the strong structure of FIG. 4 embedded therein are made at a factory, and are shipped to a dealer or builder at or near the construction site. Prior art forms, which have internal structural support and/or backing plates, have the internal strong supports molded in one piece that goes from a backing plate on one panel, through that panel, through the wall, and through the other panel. As a result, when the form is shipped the several cubic feet of space between the walls takes up room on the truck and limits the number of panels that can be carried by one truck. With my invention, the above waste space is avoided since my inside tie (FIG. 5) is installed at the construction site.

Moreover, the prior art devices now on the market, which have embedded structure, are limited in another way. If they are to be stocked by a local dealer, that dealer must have one set of forms for each thickness of wall that may be called for. With my invention, the panels 10 are the same for every wall thickness. To get various wall thicknesses, the only thing necessary is to stock different ties of the type shown in FIG. 5.

Each of the panels 10 is identical to the other ones. Each panel 10 has an inner face **10*a* facing the other form 10 and each panel has an outer face 10*b*. Mounted on each inner face 10*a* is a connecting means 14 (see FIG. 4) which may be engaged by the tieing means of FIG. 5 as previously explained. Each panel 10 has a connecting wall 10*c* that connects the inner face 10*a* to the outer face 10*b*. The connecting wall 10*c* has a periphery that runs along the top of wall 10, down the far end of FIG. 1, along the length of the connecting wall 10*c* that runs along the bottom of panel 10, and thence upwards along the connecting wall 10*c*** at its near end.

Walls made with panels 10 of the shape shown in FIGS. 1 and 2 have a so-called "post and beam configuration". The shape of the panels for making the post and beam construction is old and well known. That configuration is preferred by some architects and I therefore have shown how to apply my invention to it. I prefer, however, that the panels 10 have a uniform rectangular cross-section and panels of that shape are contemplated for all forms of the invention hereinafter described.

In order to provide a form for a concrete wall, the forms of FIG. 1 are stacked on one another, as well as end to end to create a form for a wall. The fact that the backing plates extend high enough to cover the joints as explained above aids in stacking the forms. The extensions 13 on the backing plates 12 make it easier to stack the forms and also maintains the outer wall of the forms smoother and flatter. The extensions 13 also, when attached to backing plates **12*d* by screws 13*a*, stabilizes the forms. Moreover, the fact that I employ shiplap joints between stacked forms cooperates with the extensions 13** to improve the flatness of the outer wall (both the wall on the outside of the building that carries the siding and the wall on the interior of the building that carries the dry wall).

FIG. 8 shows the preferred form of the invention. The panels 10 have a uniform rectangular cross-section along the entire length of the panel. Each panel has backing plates 12 with the extensions 13 as explained above. Each backing plate is connected by a strong structure to a connecting means (socket plate) **14*a* which has two keyhole-shaped sockets 15A (FIG. 10). Since there is a second panel 10 parallel to the first one, the second panel 10 also has a connecting means (socket) 14*a* with two keyhole sockets 15A. There is a tieing member 16, 17 having four enlarged plugs 18. When the plugs 18 of FIG. 11 are inserted into the keyhole slots 15, and the plugs moved downward to lock the plugs 18 into sockets 15A, the two panels are rigidly attached together as shown in FIG. 12**.

FIG. 9 illustrates the overlap of the backing plates. This figure shows the panel **10*f* stacked on a panel 10*e*. The panel 10*e* has an indent 10*g* which extends inwardly from the outer face 10*h* of the panel and also extends to the periphery 10*j* of the panel 10*e*. The panel 10*f* has a projection 10*k* that mates with the indent 10*g*. The panel 10*f* has a backing plate 12*d* which extends along the surface of panel 10*f* to the lower end of the projection 10*k*. The backing plate 12*e* extends along the surface of panel 10*e* and upwardly to overlap at 13 both said projection 10*k* and a limited portion of backing plate 12*d***.

It is evident that when panel **10*f* has yet to be inserted in mating relation with panel 10*e*, that the backing plate 12*e* projects in spaced relation to, and parallel to wall 10*m* of panel 10*e*. This results in a short open slot in the upper side of panel 10*e* as shown in FIG. 1. The presence of this slot makes it easy to guide the projection 10*k* into the slot that is between wall 10*m* and backing plate extension 13 (FIG. 9). Moreover, the overlapping portion 13 of backing plates (such as 12*e*) and the projections such as 10*k***, result in a smoother, flatter outer surface of a series of stacked panels. Irregularities in the outer faces of the panels can distort the wall coverings that may be attached to the backing plates.

The connecting means 14A of FIG. 10 when mounted on one of the panels 10 (FIG. 12) can be tied to a similar connecting means on the other panel 10 of FIG. 12 by the tieing means of FIG. 11. In FIG. 12, each of the connecting means 14A is connected to a backing plate 12 by a strong structure 19.

The concrete form of FIG. 12 is made as shown in FIG. 6 and as follows. At a factory each panel 10 is molded as follows: The connecting means 14A, the strong structures 15 and the backing plates 12 that are a part of a panel will be placed in a mold M (FIG. 6): If the panel requires the protection of several backing plates all of them will be in the mold along with their strong structures 19 and their connecting means:) The foam is then fed into the mold via pipe P to embed all of the parts in the mold.

The molded panels are then shipped separately, and joined together with said tieing means at the construction site.

The builder at the construction site may select the thickness of the concrete wall by selecting a tieing means to give the desired width of wall.

Figure 13:
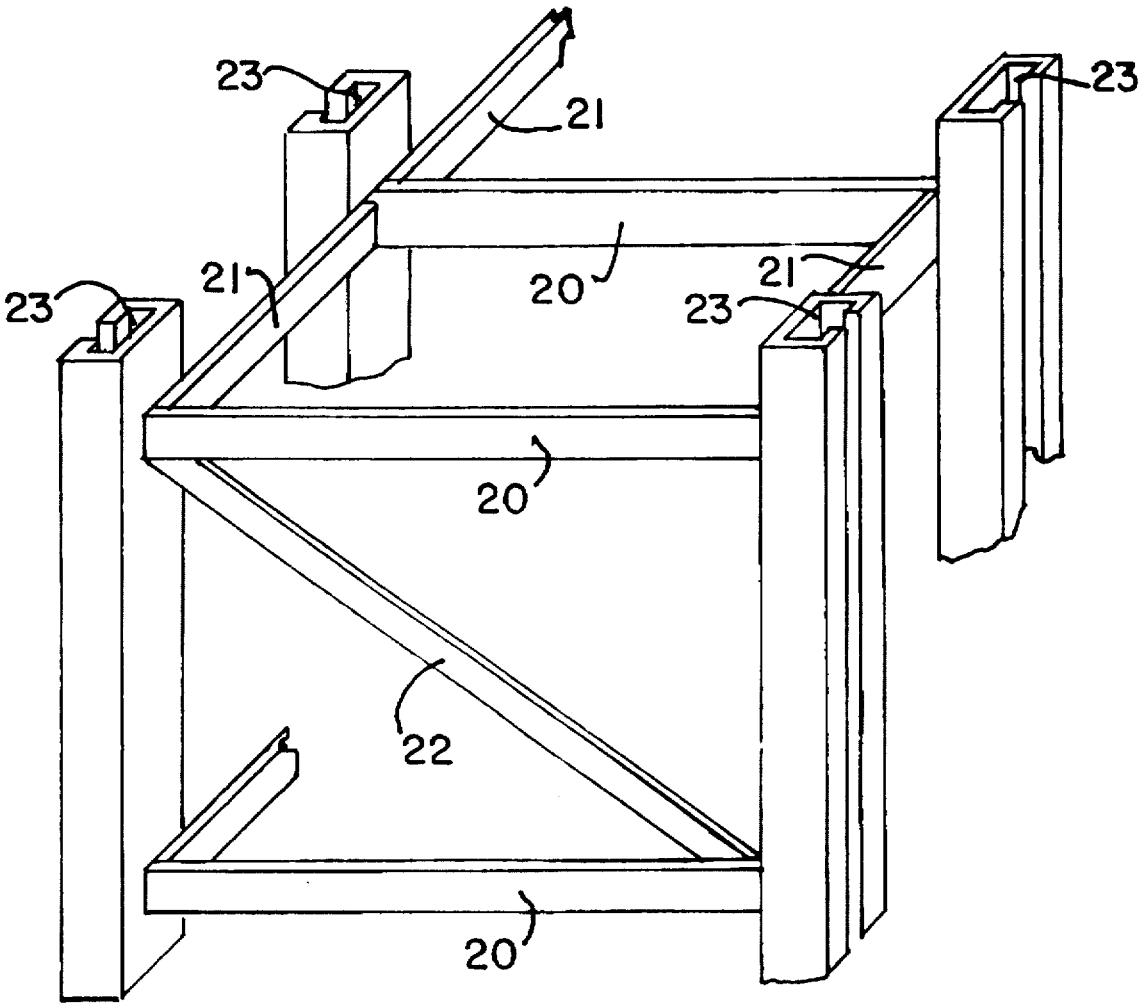
FIG. 13 is an isometric view showing two sockets, one for each of two of said strong structures.

FIG. 13 shows a modified form of tieing means. With this tieing means there is a strong structure 20, 21, 22 holding four slotted strips 23 that can engage suitable connecting means having a vertical strip.

Figure 14:
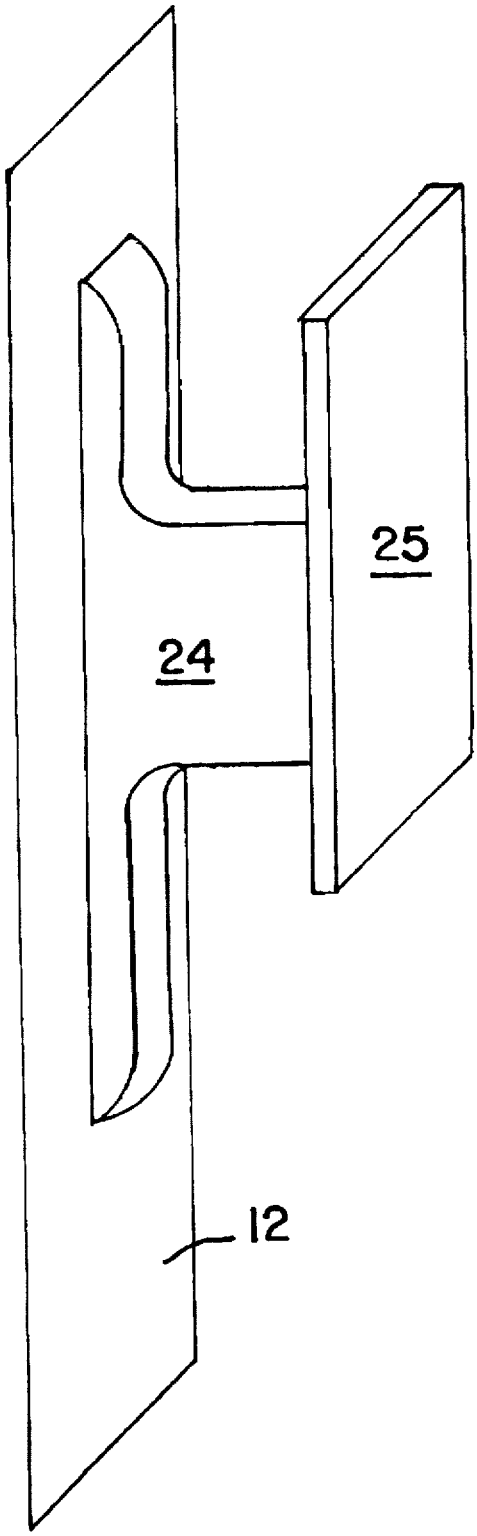
FIG. 14 is an isometric view of a modified form of the invention.

FIG. 14 shows another form of connecting means 25 in the form of a wide vertical strip. This strip is connected to a backing plate by strong structure 24.

Figure 15:
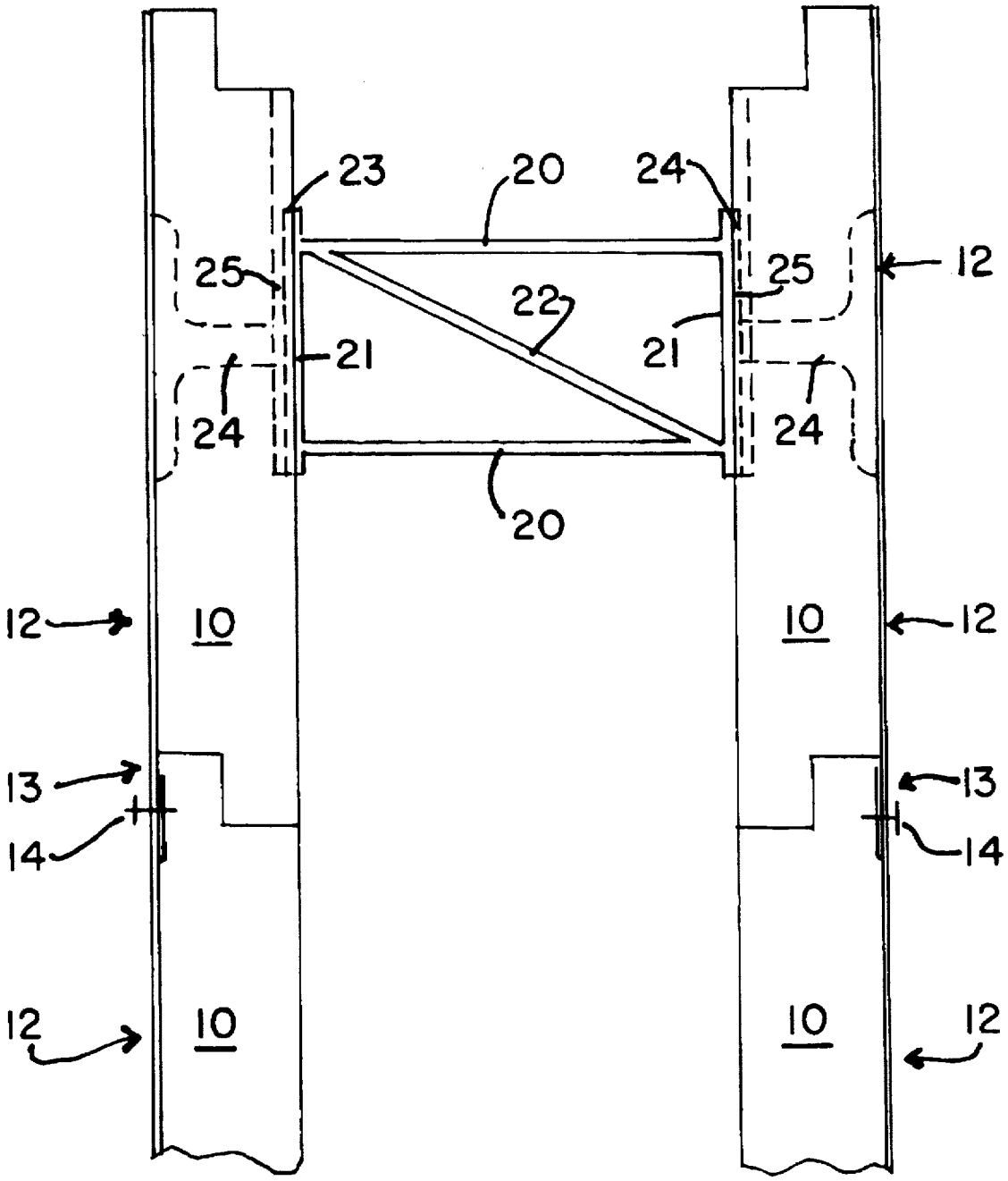
FIG. 15 is a cross-sectional view of a form that embodies the invention.

FIG. 15 shows how the connecting means 25 of FIG. 14 on two panels can be held from outward movement, despite the force of fluid concrete. The tieing means has strong structure 20, 22 and sockets 21.

Thus, FIG. 15 shows a complete form embodying two panels 12, each having the structure of FIG. 14 molded into it. A flat strip 25 (FIG. 14) is adjacent the inner surface of each panel 12 of FIG. 15. The apparatus 20, 21, 22 (see FIG. 13) has C-shaped grooves 23 which mate with the strips 25 (FIG. 14). The apparatus of FIG. 13 is added to the two panels 12 at the job site.

FIG. 7 illustrates a wall constructed on a previously poured concrete base 56 using a plurality of panel assemblies 10. The wall is formed by taking numerous panel assemblies 10, as described above, and placing them one on top of the other and edge-to-edge on concrete base 56 until a complete wall is formed. The lower edge of the bottom panel 12 rests on wood cleats 48 which are in turn fastened to concrete base 56 by concrete nails 50. The purpose of using wood cleats 48 is, of course, to stabilize the wall being constructed both in a horizontal and vertical direction and to help keep the wall plumb during the pouring of concrete 28.

I claim to have invented:

1. A form to hold concrete while it hardens, comprising:

first and second molded panels of insulating material, each panel having an inner and an outer face, said panels being capable of being placed in a spaced apart parallel relationship with said inner faces facing each other, a first backing plate adjacent the outer face of said first panel, a second backing plate adjacent the outer face of said second panel, first connecting means on the inner face of said first panel, second connecting means on the inner face of said second panel, first structural means extending from said first backing plate to said first connecting means, for preventing said first backing plate from moving outward relative to said first connecting means, second structural means extending from said second backing plate to said second connecting means, for preventing said second backing plate from moving outward relative to said second connecting means, each said first and second structural means being molded into its respective molded panel, each panel supporting and holding its backing plate, its connecting means and its structural means prior to the pouring of concrete into the form, and tieing means, which is a piece separate from at least one of said connecting means but which may be attached to it, for preventing the connecting means on one of said panels from moving away from the connecting means on the other of said panels while concrete is poured into the space between said panels.

2. A device as defined in claim 1, wherein said tieing means is a piece separate from both of said first connecting means and said second connecting means.

3. A device as defined in claim 2, in which each of said connecting means includes means that mates with said tieing means to form a strong connection.

4. A device as defined in claim 3, wherein said panels are entirely separate from each other until said tieing means is joined to both of said first and second connecting means; said panels comprising separate panels for shipping purposes but which may be connected together by said tieing means before using the same for concrete formwork.

5. A device as defined in claim 1, wherein said panels have a density of no more than 4.5 pounds per cubic foot.

6. A device as defined in claim 5, wherein the insulating material comprises foam having a density in the range of 1.5 to 3 pounds per cubic foot.

7. A device as defined in claim 1 in which one of said panels defines an indent in its outer face, a third panel having a projection that will fit into said indent, said third panel having an outer face, a backing plate extending along said outer face of said third panel and overlapping said projection.

8. A device as defined in claim 7, in which said third panel has a projection that will enter said indent, said backing plate on said third panel overlapping the projection on the third panel.

9. A device as defined in claim 1, including, for each panel, means for preventing substantial outer movement of any part of the outer face of the panel comprising spaced backing plates on the outer face of the panel.

10. A form as defined in claim 1, in which each of said tieing means and one of the connecting means is a member, one of said members having a generally C-shape and the other of said members comprising means for engaging an inner wall of said generally C-shaped member to tie the members together.

11. A form as defined in claim 1, in which each of said tieing means and one of the connecting means is a member, one of said members defining a hole of keyhole shape and the other of said members comprising means for entering said hole and then movable to a position that locks the members together.

12. A form as defined in claim 1, in which each of said first and second structural means comprises a series of spaced members.

13. A form as defined in claim 1, in which said first structural means comprises a first series of spaced members extending from said first connecting means to said first backing plate, said first series of spaced members being respectively attached to spaced positions along said first backing plate, said second structural means comprises a second series of spaced members extending from said second connecting means to said second backing plate, said second series of spaced members being respectively attached to spaced positions along said second backing plate.

14. The method of making concrete formwork, comprising:

making, at one location, a number of panels each of which has: (a) an inner face and an outer face, (b) at least one backing plate on said outer face, (c) a connecting means on said inner face and (d) structural means connecting said backing plate to said connecting means for preventing outer movement of said backing plate, said step of making, as for each panel, comprising placing said parts (b), (c) and (d) in a mold, placing in the mold a foam plastic and embedding said elements (b), (c) and (d) in the molded panel having the above-mentioned faces, said step of making each of said panels providing a panel that is not connected in spaced relation to another panel, providing tieing means for tieing together the connecting means on two of said panels, shipping said panels, to another location, and connecting two said panels together with said tieing means.

15. The method of claim 14, wherein said step of making panels comprises making the panels of foam that has a density not greater than 4.5, pounds per cubic foot with said structural means molded into the foam.

16. The method of making formwork to hold concrete while it is curing, comprising:

(a) providing a mold for making a panel, of moldable insulating material that cures in the mold, that has inner and outer faces, (b) providing a structure having a backing plate, a connecting means and a member interconnecting said plate and said means, (c) positioning said structure in said mold to place said backing plate near one of said faces and said means near the other of said faces, (d) placing insulating material in said mold and allowing it to cure and embed said member and forming a first foam panel, making a second panel, according to steps (a), (b), (c) and (d), that is entirely separate from the first panel, shipping said panels to a construction site, providing a tieing means for interconnecting the connecting means on the first panel to the connecting means on the second panel, said step of providing the tieing means comprising providing tieing means that is not connected to at least one of said connecting means, and connecting the connecting means on the first panel to the connecting means on the second panel, with said tieing means, for preventing the connecting means on said first panel from moving away from the connecting means on the second panel.

17. The method of claim 16, comprising:

providing a multiplicity of pairs of panels tied together as defined in claim 16, stacking some of said pairs of panels and placing other of said pairs end to end for providing a formwork, and pouring concrete into said formwork.

18. The method of claim 17, which includes providing said backing plates on the outer surfaces of the panels.

* * * * *

UNITED STATES PATENT AND TRADEMARK OFFICE

CERTIFICATE OF CORRECTION

PATENT NO. : 5,735,093

DATED : April 7, 1998

INVENTOR(S) : George A. Grutsch

It is certified that error appears in the above-identified patent and that said Letters Patent is hereby corrected as shown below:

Title page, Under Item 58, References Cited, add:

| | | |
|---|---|---|
| 5,459,971 | 10/95 | Sparkman |
| 5,065,561 | 11/91 | Mason |
| 5,625,989 | 5/97 | Brubaker et al. |
| 4,967,528 | 11/90 | Doran |
| 4,884,382 | 12/89 | Horobin |
| 5,390,459 | 2/95 | Mensen |
| 2,061,486 | 11/36 | Schuh |
| 2,316,819 | 4/43 | Tedrow |

Col. 1, line 50, change "embedded in" to: -- molded into --.

Col. 1, line 52, after "concrete." insert: -- A backing plate is hereby defined as a plate closely adjacent the exterior surface of a panel and which not only assists in preserving the panel against distortion and outward movement but also provides an extended surface for the attachment of a wall covering. --

Claim 5, line 1, after "panels" insert: -- each comprise a foam and --.

Claim 16, line 7, after "placing" insert: --foam--.

Signed and Sealed this

Twenty-fourth Day of November, 1998

*Attest:*

Bruce Lehman

BRUCE LEHMAN

*Attesting Officer*

*Commissioner of Patents and Trademarks*